United States Patent [19]

Scott, deceased

[11] 4,111,640

[45] Sep. 5, 1978

[54] CYCLING PILOT BURNER CONTROL SYSTEM WITH PRESSURE SWITCH

[75] Inventor: Walter W. Scott, deceased, late of Willowick, Ohio, by Jayne E. Scott, executrix

[73] Assignee: Emerson Electric Co., St. Louis, Mo.

[21] Appl. No.: 794,555

[22] Filed: May 6, 1977

[51] Int. Cl.[2] ..... F23Q 9/08

[52] U.S. Cl. ..... 431/46; 431/54; 431/58

[58] Field of Search ..... 431/45–47, 431/54, 58, 61; 137/65, 66

[56] References Cited

U.S. PATENT DOCUMENTS 3,975,135 8/1976 Kihsella ..... 431/58

4,060,370 11/1977 Fleer ..... 431/54

*Primary Examiner*—Carroll B. Dority, Jr.

*Attorney, Agent, or Firm*—Paul A. Becker, Sr.

[57] ABSTRACT

A gas burner control system including a main burner and a pilot burner for igniting the main burner wherein the pilot burner is ignited only when the thermostat is calling for heat and gas is permitted to flow to the main burner only after the existence of a pilot burner flame adequate to ignite the main burner has been proven. A pressure actuated switch is effective, following an electrical power interruption or a failure of or an appreciable reduction in gas pressure, to prevent the resumption of gas flow to the main burner until a pilot burner flame adequate to ignite the main burner has been re-established.

6 Claims, 1 Drawing Figure

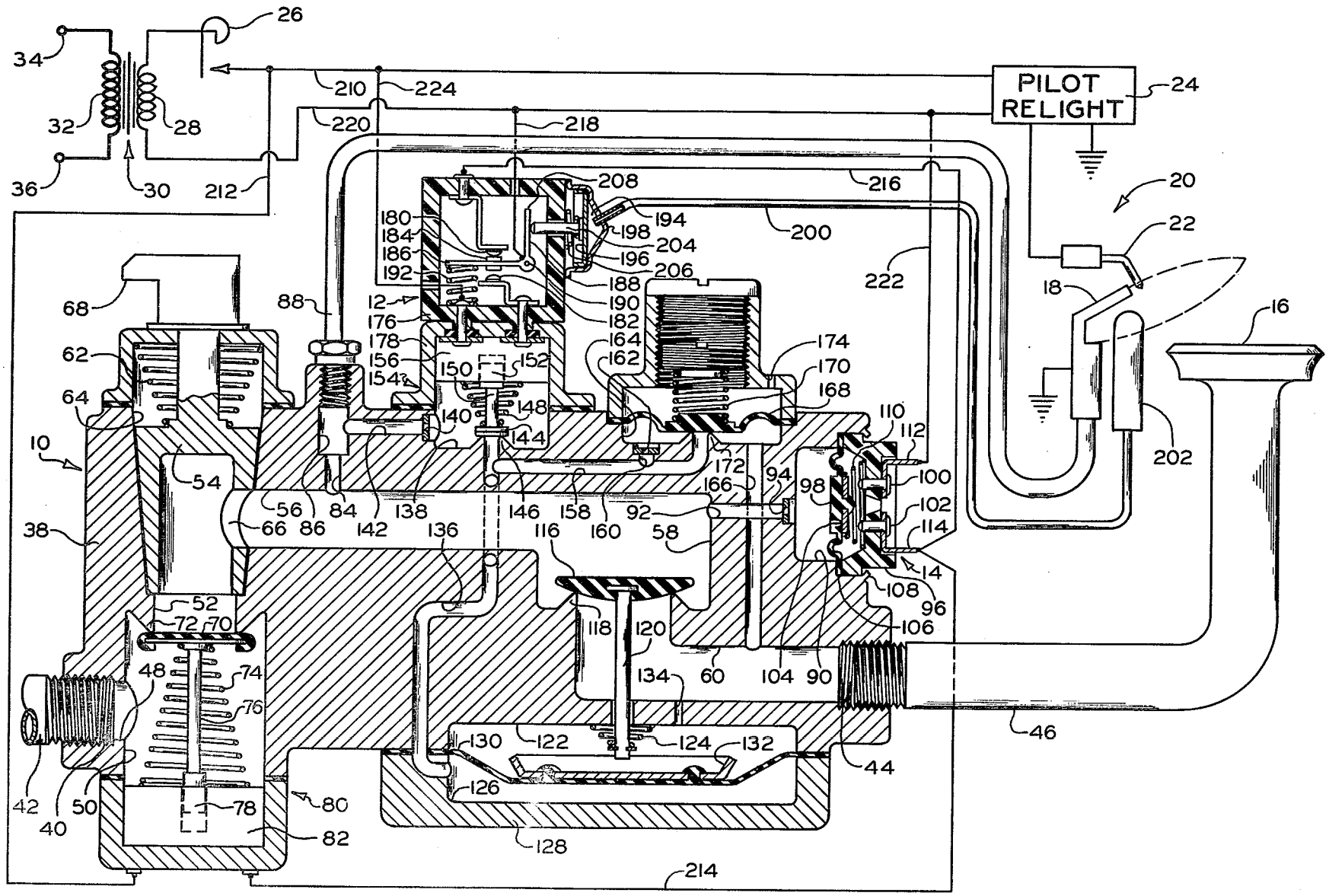
PILOT
RELIGHT

CYCLING PILOT BURNER CONTROL SYSTEM WITH PRESSURE SWITCH

This invention relates to electrically operated control systems for gas burners in which a pilot burner is cycled on and off with the closing and opening of a space thermostat, and a main burner disposed to be ignited by the pilot burner is supplied with fuel only after the existence of the pilot burner flame has been proven by thermostatic means heated by the pilot burner flame, and particularly to such a system wherein the re-institution of gas flow to the main burner following the cut off thereof due to a gas interruption, an appreciable gas pressure decrease, or an electrical power interruption, is precluded until a pilot flame adequate to ignite the main burner has been re-established.

Application Ser. No. 749,724, filed Dec. 13, 1976, now U.S. Pat. No. 4,080,154, for GAS BURNER CONTROL SYSTEM WITH CYCLING PILOT by Howard R. Kinsella, assignor to the assignee of the present invention, discloses a gas burner control system in which a first normally closed electromagnetically operated valve controls gas flow to a pilot burner and, in conjunction with a second electromagnetically operated valve, controls the application of gas pressure to a diaphragm chamber which effects opening of a normally closed diaphragm operated valve fluidically in series with the first valve between the gas source and a main burner. Upon closure of a space thermostat, the first valve opens and a spark igniter is electrically energized and becomes operative to ignite the pilot burner. A mercury-filled bulb is impinged by the pilot flame and, after a period of time, effects the opening of a set of "cold" contacts and the closing of a set of "hot" contacts. The opening of the "cold" contacts breaks a pull-in circuit for the first valve, which valve is subsequently held in through a resistor connected in parallel with the "cold" contacts. The closing of the "hot" contacts enables the second valve to open and allows gas pressure to be applied to the diaphragm chamber which effects opening of the diaphragm operated valve. Gas then flows to the main burner which is ignited by the pilot burner flame.

In this arrangement, if there is an electrical power failure, the first and second electromagnetically operated valves close immediately, the first valve cutting off all gas flow. When power is restored, gas flow to the main burner prior to re-establishment of the pilot burner flame is prevented, regardless of the time duration of the power failure. Specifically, if the duration of the power failure is sufficiently long to allow the mercury to cool and cause the "cold" contacts to close and the "hot" contacts to open, the system again functions in the same manner as described above; if the duration of the power failure is insufficient to allow the "cold" contacts to close and the "hot" contacts to open, the first valve will not open when power is restored because the resistor in series with the winding of the first valve is of sufficiently high impedance to prevent energizing the winding to the level required to effect pull-in. The first valve is subsequently opened when the mercury cools sufficiently to cause the "cold" contact to close. The "cold" contacts shunt the resistor and permit the winding to be energized at the higher level required to effect pull-in of the valve. The spark igniter, operable when power is restored, then ignites the pilot burner. The main burner is subsequently ignited by the pilot burner flame as described above.

While this arrangement thus functions satisfactorily when there is an electrical power failure, there is another condition which can occur, namely, a gas interruption, when this arrangement does not function satisfactory. Specifically, in the above described arrangement, if there is a gas interruption when the thermostat is closed and the main burner is ignited, gas flow terminates, the spark igniter remains energized, the first and second electromagnetically operated valves remain open, and the diaphragm operated valve closes. If gas flow is restored before the thermostat opens and before the mercury cools sufficiently to effect the opening of the "hot" contacts which would cause the de-energizing of the second valve, the diaphragm operated valve is opened and gas flows to the main burner. At the same time, gas flows to the pilot burner to be ignited by the energized spark igniter. This condition, wherein a large amount of gas flows to the main burner at the same time that ignition of the pilot burner is attempted, is considered undesirable in that when the burners are enclosed within the confines of a combustion chamber, even a slight delay in the ignition of the pilot burner presents a potentially hazardous condition.

An object of the present invention, therefore, is to provide a gas burner control system of the cycling pilot burner type in which means are provided to ensure the establishment of an adequate pilot burner flame under all conditions of operation prior to admission of gas flow to the main burner.

A further object is to provide a gas burner control system of the cycling pilot burner type in which gas pressure responsive means are provided to preclude gas flow to a main burner following an electrical power or gas interruption until a pilot burner flame capable of igniting the main burner has been established.

More specifically, it is an object to provide a gas burner control system in which a pilot burner is cycled on and off with the closing and opening of a thermostat; in which switch means actuated by thermostatic means responsive to pilot burner flame is effective in a first "cold" position to effect the opening of a first valve having primary control of the flow of gas to the pilot burner and to a main burner, and in a second "hot" position to effect the opening of a second valve which, when the first valve is open, allows to give to flow to the main burner; in which pressure responsive switch means actuated to a closed contact position when gas of sufficient pressure is flowing to the pilot burner is effective, when in its closed contact position and when the thermostatically actuated switch means is in its "hot" position, to provide a hold-in circuit for the first valve, and effective, when in its open contact position due to an electrical power interruption or a gas flow interruption or a large decrease in gas pressure, any of which cause the first valve to close, to prevent the first valve from subsequently opening until the thermostatically actuated switch returns to its "cold" position.

Further objects and advantages will appear from the following description when read in conjunction with the accompanying drawing.

The single FIGURE of the drawing is a schematic illustration of a gas burner control system constructed in accordance with the present invention.

DESCRIPTION OF THE PREFERRED EMBODIMENT

Referring to the single FIGURE of the drawing, the control system includes as primary elements, a manifold gas valve device generally indicated at 10 and including a thermostatically actuated switch 12 and a pressure actuated switch 14, a main burner 16, a pilot burner 18, a spark igniter 20 comprising a spark electrode 22 and spark generating means 24, and a space thermostat 26. The system is adapted to be electrically energized by the secondary winding 28 of a voltage step-down transformer 30 having its primary winding 32 connected across terminals 34 and 36 of a conventional 120 volt alternating current power source.

The manifold gas valve device 10 comprises a body 38 having an inlet 40 receiving a gas supply conduit 42 and an outlet 44 receiving a gas conduit 46 leading to the main burner 16. Connecting inlet 40 and outlet 44 is a main fuel passageway means including an inlet passage 48, a chamber 50, a passage 52, a hollow rotary plug cock 54, a passage 56, a chamber 58, and an outlet passage 60.

Plug cock 54 is biased downwardly by a spring 62 into seating engagement in a vertical tapered bore 64 in body 38 and has a port 66 in the wall thereof which registers with passage 56 when the plug cock 54 is rotated by means of an attached knob 68 to an "on" position.

A biased closed electromagnetically opened primary control valve 70 cooperates with an annular seat 72 formed at the lower end of passage 52 to control all gas flow through the manifold valve device 10. The valve 70 is biased closed on seat 72 by a spring 74 and has a stem 76 connected to the plunger 78 of a solenoid 80 having a winding 82. Valve 70 is opened when winding 82 is energized and is closed by spring 74 when winding 82 is de-energized.

Whenever valve 70 is open and plug cock 54 is in the "on" position wherein port 66 registers with passage 56, gas is supplied to the pilot burner 18 via passage 56, a passage 84, a chamber 86, and a conduit 88. Sparking occurs between electrode 22 and grounded conductive metal pilot burner 18 to ignite the gas. The spark generating means 24 for producing high voltage sparks may be of any suitable construction and arrangement and preferably includes means responsive to the occurrence of pilot flame to cut off the sparking. Spark generating means of this kind is disclosed in U.S. Pat. No. 3,894,273.

Also when valve 70 is open and plug cock 54 is in the "on" position, inlet gas pressure is supplied to a diaphragm chamber 90 to operate the pressure actuated switch 14, chamber 90 being in communication with chamber 58 through a passage 92 and an orifice 94. Chamber 90 is formed as a bottom portion of a stepped circular cavity in valve body 38. Secured in a larger diameter top portion of the stepped circular cavity is the pressure actuated switch 14.

Switch 14 comprises a rigid circular cup-shaped member 96 formed of dielectric material, a flexible circular diaphragm member 98 also formed of dielectric material, solid rivet type stationary contacts 100 and 102 spaced in cup member 96, and a movable contact 104 attached to the central portion of diaphragm member 98. Peripheral portions of the cup-shaped member 96 and the diaphragm member 98 are received in the stepped circular cavity with the peripheral portion of the diaphragm member 98 lying against an annular shoulder 106 formed between the bottom and top portions of the cavity and the peripheral portion of the cup-shaped member 96 overlying the peripheral portion of diaphragm member 98. The peripheral portion of the cup-shaped member 96 is pressed against the diaphragm member 98 and shoulder 106 and held firmly fixed by staking as indicated at 108. The diaphragm member 98 and attached contact 104 are biased away from contacts 100 and 102 by a spring 110. attached to stationary contacts 100 and 102 and extending outwardly therefrom are connector terminals 112 and 114, respectively.

A valve 116 cooperates with an annular valve seat 118 formed in chamber 58 for controlling the gas flow to outlet passage 60 and the main burner 16. Valve 116 has a stem 120 extending downwardly into an upper diaphragm chamber 122 formed as a recess in a valve body 38, and a spring 124 biases valve 116 downwardly to a closed position on its seat 118. A lower diaphragm chamber 126 is formed by a cup-shaped member 128 attached by any suitable means to valve body 38. A flexible diaphragm 130 is clamped at its periphery between valve body 38 and member 128 and forms a flexible wall between upper and lower diaphragm chambers 122 and 126, respectively. A relatively rigid disc 132 is centrally positioned and attached to diaphragm 130 and is effective to engage the lower end of valve stem 120 and move valve 116 upwardly toward an open position when sufficient gas pressure is applied to the lower side of diaphragm 130.

The upper diaphragm chamber 122 is adequately vented to outlet passage 60 through a vent 134 so that the upper side of diaphragm 130 is constantly exposed to the pressure existing in outlet passage 60. The lower diaphragm 126 communicates with inlet passage 48 through a passage 136, a valve chamber 138, an orifice 140, a passage 142, chamber 86, passages 84 and 56, port 66, plug cock 54, passage 52, and chamber 50. A biased closed electromagnetically opened valve 144 cooperates with an annular valve seat 146 formed around the entrance of passage 136 into valve chamber 138 to control the admission of inlet gas to the lower diaphragm chamber 126. Valve 144 is biased closed on seat 146 by a spring 148 and has a stem 150 connected to the plunger 152 of a solenoid 154 having a winding 156. Valve 144 is opened when winding 156 is energized and is closed by spring 148 when winding 156 is de-energized.

The gas pressure in the lower diaphragm chamber 126 which is applied to the lower side of diaphragm 130 is always something less than the supply pressure at inlet 40 due to the pressure dropping orifice 140 and because of a constant and a variable bleed-off means between the passage 136 and outlet passage 60 through branch passage means. The branch passage means comprises passages 158 and 160, an orifice 162, a valve chamber 164, and a passage 166. The variable bleed-off means, which varies the bleed-off rate through passage 158 in response to outlet pressure variations so as to maintain some predetermined outlet pressure, comprises a diaphragm type pressure regulator valve 168 biased by an adjustable spring 170 toward a closed position on an annular seat 172 formed around the entrance of passage 158 into valve chamber 164. The side of valve 168 opposite that facing chamber 164 is exposed to atmospheric pressure through a vent 174.

The constant bleed-off means, which bypasses the pressure regulator valve 168 and provides a function to be later described, comprises passages 158 and 160, orifice 162, chamber 164 and passage 166.

Thermostatically actuated switch 12 comprises a casing 176 which, for convenience of illustration, is shown mounted on a housing member 178 of solenoid 154. A pair of stationary contacts 180 and 182 in switch 12 cooperate with a double-headed movable contact 184 to complete and break circuits to be hereinafter described. The movable contact 184 is mounted on one leg 186 of an L-shaped switch blade 188 pivoted on a pin 190, leg 186 extending between stationary contacts 180 and 182 to enable alternate engagement of movable contact 184 with stationary contacts 180 and 182. A spring 192 biases movable contact 184 against stationary contact 180 when switch 12 is in a "cold" position.

An expandable chamber 194 is defined by an inner flexible metal cup 196 and an outer rigid metal cup 198, cup 198 being attached to switch casing 176. Chamber 194 is connected by a capillary tube 200 to a bulb 202 mounted adjacent pilot burner 18. The expansible chamber 194, capillary tube 200, and bulb 202 comprise a sealed system filled with a thermally expansible fluid such as mercury, with bulb 202 positioned so as to be impinged by the pilot flame.

An actuator rod 204 is biased at one end by a spring 206 against the inner flexible cup 196 and at its other end bears against the other leg 208 of the L-shaped switch blade 188. Upon expansion of the expansible chamber 194, actuator rod 204 causes pivoted switch blade 188 to pivot counterclockwise about pin 190, causing movable contact 184 to break from stationary contact 180 and make with stationary contact 182. When this switching is completed, switch 12 is in a "hot" position.

When thermostatically actuated switch is in the "cold" position, with its contacts 180 and 184 closed, the winding 82 of solenoid 80 is connected across the transformer secondary winding 28 through thermostat 26, a lead 210, a lead 212, winding 82, a lead 214, a lead 216, stationary contact 180, movable contact 184, a lead 218, and a lead 220. A holding circuit for winding 82 paralleling switch 12 and comprising the pressure actuated switch 14 and a lead 222 connects winding 82 across the transformer secondary winding 28 when the stationary contacts 100 and 102 are connected by movable contact 104.

When thermostatically actuated switch 12 is in the "hot" position, with its contacts 182 and 184 closed, the winding 156 of solenoid 154 is connected across the transformer secondary winding 28 through thermostat 26, lead 210, a lead 224, winding 156, stationary contact 182, movable contact 184, and leads 218 and 220.

The spark generating means 24 is connected across the transformer secondary winding 28 through thermostat 26 and leads 210 and 220.

OPERATION

The system is shown in a cold position with electromagnetically operated valves 70 and 144 and pressure operated valve 116 all biased closed and thermostatically actuated switch 12 in the "cold" position but with plug cock 54 rotated to the "on" position. Under these conditions, the closing of the contacts in the thermostat 26 causes solenoid winding 82 to be connected across the transformer secondary winding 28 through thermostat 26, leads 212, 214, and 216, contacts 180 and 184, and leads 218 and 220. The closing of the contacts in thermostat 26 also concurrently connects the spark generating means 24 across the transformer secondary winding 28 through thermostat 26, lead 210, and lead 220. Therefore, valve 70 is opened, permitting gas to flow to the pilot burner 18, and the gas is ignited by sparks produced between electrode 22 and pilot burner 18.

The opening of valve 70 also permits gas to flow to chamber 90. The gas pressure in chamber 90 causes the flexible diaphragm 98 in the pressure actuated switch 14 to move outwardly against the bias of spring 110 to effect the connection of stationary contacts 100 and 102 by movable contact 104. Lead 222 and the electrical connection of contacts 100 and 102 provides a circuit paralleling the contacts 180 and 184 in thermostatically actuated switch 12 for a reason to be hereinafter described.

When the fluid in bulb 202 becomes sufficiently heated by the pilot burner flame to expand expansible chamber 194 to cause contacts 180 and 184 to open and contacts 182 and 184 to close, the electromagnetically operated valve 144 is opened, winding 156 controlling valve 144 being energized by the transformer secondary winding 28 through the thermostat 26, leads 210 and 224, contacts 182 and 184, and leads 218 and 220. When contacts 180 and 184 open, valve 70 remains open due to the parallel circuit provided by lead 222 and contacts 100, 102, and 104 in the presence actuated switch 14.

The opening of valve 144 permits gas to flow to the lower diaphragm chamber portion 126 increasing the pressure therein and causing valve 116 to be opened. Gas now flows to the main burner 16 to be ignited by the pilot burner flame. The pressure in lower diaphragm chamber portion 126 and, consequently, the degree of opening of valve 116, will be regulated by regulator valve 168 to maintain a predetermined outlet pressure in passage 60. The main burner 16 and pilot burner 18 will continue to burn until thermostat 26 opens, whereupon electromagnetically operated valves 70 and 144 instantly close and valve 116 closes immediately thereafter. When valves 70 and 144 close, the existing pressure in lower diaphragm chamber portion 126 immediately exhausts to outlet passage 60 through passages 136, 158, and 160, orifice 162, chamber 164, and passage 166, permitting immediate closure of valve 116 under the bias of spring 124. The orifice 140 at the entrance of valve chamber 138 is sufficiently larger than the constant bleed-off orifice 162 to maintain sufficient operating pressure in lower diaphragm chamber portion 126 when valve 144 is open. The purpose of orifice 140 is to limit the operating pressure to a range wherein the pressure regulator valve 168 will operate accurately.

If upon starting burner operation from a cold position in response to closure of thermostat 26 the pilot burner 18 fails to ignite or fails to provide an adequate flame to heat bulb 202, the thermostatically actuated switch 12 will remain in its "cold" position and valves 144 and 116 will remain closed so that no gas flows to the main burner 16.

If during normal burner operation the electrical power source fails, valves 70, 144, and 116 close, causing all gas flow through valve device 10 to cease. The cessation of gas flow causes the extinguishing of pilot burner flame and main burner flame and causes contacts 100 and 102 in the pressure actuated switch 14 to open. Upon resumption of electrical power, the primary control valve 70 is thus prevented from opening until the thermostatically actuated switch 12 has cooled sufficiently to close its "cold" contacts 180 and 184.

If during normal burner operation the gas supply fails, the pilot burner flame and main burner flame are extinguished and contacts 100 and 102 in the pressure actuated switch 14 are opened. Since during normal burner operation the thermostatically actuated switch 12 is in its "hot" position wherein contacts 180 and 184 are open and solenoid winding 82 is energized through contacts 100, 102, and 104 of the pressure actuated switch 14, the disconnection of contacts 100 and 102 causes the primary control valve 70 to close. Upon resumption of the gas supply, the primary control valve 70 is thus prevented from opening until the thermostatically actuated switch 12 has cooled sufficiently to close its "cold" contacts 180 and 184.

Therefore, the simultaneous flow of unignited gas to the pilot burner 18 and main burner 16 upon restoration of electrical power following a short period of an electrical power failure and upon restorating of the gas supply following a short period of a gas supply failure is prevented by the pressure actuated switch 14.

The pressure actuated switch 14 is also effective to ensure that gas will not flow to the main burner 16 under conditions wherein the pilot flame is inadequate to reliably ignite the main burner 16. That is to say, the construction parameters of the diaphragm 98 and spring 110 in pressure actuated switch 14 are such that the valve of gas pressure required to effect the closing of contacts 100 and 102 is higher than the minimum value of gas pressure required to provide a pilot burner flame adequate to ignite the main burner 16. Thus, should a reduced gas pressure condition exist wherein the pilot burner flame is adequate to cause contacts 182 and 184 in thermostatically actuated switch 12 to close but inadequate to reliably ignite the main burner 16, the contacts 100 and 102 in the pressure actuated switch 14 remain open thereby causing the primary control valve 70 to close when thermostatically actuated switch 12 switches from its "cold" position, contacts 180 and 184 closed, to its "hot" position, contacts 182 and 184 closed. It is noted that in systems utilizing a mercury-filled bulb, generally a pilot burner flame inadequate to ignite a main burner is also inadequate to effect switching of the mercury actuated switch to a "hot" position. However, there are other known temperature sensing means responsive to pilot burner flame that could be utilized, such as differential expansion types, that are somewhat more likely than a mercury-filled bulb to effect switching from a "cold" position to a "hot" position with a pilot burner flame inadequate to reliably ignite the main burner.

I claim:

1. In a gas burner control system, an electrical power source;

a main burner;

a pilot burner for igniting said main burner;

a space thermostat;

electrically operated ignition means controlled by said thermostat for igniting said pilot burner;

a gas valve device including first and second valves connected fluidically in series;

a thermostatically actuated switch responsive to pilot burner flame and having a cold position in the absence of said pilot burner flame and a hot position when said pilot burner flame exists;

said first valve controlling gas flow to said pilot burner and main burner and including an electrical winding;

first circuit means including said thermostatically actuated switch in said cold position connecting said winding across said power source through said thermostat for opening said first valve;

a bypass passage connected fluidically between said first and second valves and operatively to said second valve;

a third valve located in said bypass passage and having an electrical winding;

said second valve controlling gas flow to said main burner and operative to an open position in response to energizing of said electrical winding of said third valve;

second circuit means including said thermostatically actuated switch in said hot position connecting said electrical winding of said third valve across said power source through said thermostat;

a pressure actuated switch responsive to gas pressure at a point between said first and second valves and having a closed contact position whenever gas flow of sufficient pressure exists and an open contact position in the absence of said gas flow of sufficient pressure; and third circuit means including said pressure actuated switch in said closed contact position connecting said winding of said first valve across said power source through said thermostat for maintaining said first valve open when said thermostatically actuated switch is in said hot position.

2. The gas burner control system claimed in claim 1 wherein said thermostatically actuated switch and said pressure actuated switch are integral with said gas valve device.

3. In a gas burner control system, an electrical power source;

a source of gas under pressure;

a main burner;

a pilot burner for igniting said main burner;

a space thermostat;

electrically operated ignition means connected across said power source through said thermostat for igniting said pilot burner;

a manifold valve device comprising a body having an inlet connected to said gas source, an outlet connected to said main burner, and a main gas passageway connecting said inlet and outlet;

a first valve in said main gas passageway for controlling the flow of gas from said inlet to said outlet and including a controlling electrical winding;

a second valve in said main gas passageway downstream from said first valve for controlling the flow of gas from said main gas passageway to said outlet and being a pressure operated valve;

an expansible chamber operatively connected to and effective to open said second valve when said chamber is in communication with said inlet;

first and second branch passages leading from said main gas passageway between said first and second valves for connection with said pilot burner and said expansible chamber, respectively;

a third valve in said second branch passage for controlling the flow of gas to said expansible chamber and including a controlling electrical winding;

a double-throw thermostatically actuated switch having a cold position and a hot position;

a thermostatic actuator arranged to be heated by pilot burner flame and operative when sufficiently heated to move said thermostatically actuated switch from said cold position to said hot position;

first circuit means including said thermostatically actuated switch in said cold position connecting said winding of said first valve across said power source through said thermostat for opening said first valve;

second circuit means including said thermostatically actuated switch in said hot position connecting said winding of said third valve across said power source through said thermostat for opening said third valve, which opening effects the opening of said second valve;

a pressure actuated switch having an open contact position and a closed contact position;

an expansible chamber operatively connected to and effective to actuate said pressure actuated switch to said closed contact position when said chamber of said pressure actuated switch is exposed to a predetermined gas pressure;

a third branch passage leading from said main gas passageway between said first and second valves connecting said main gas passageway with said expansible chamber of said pressure actuated switch;

third circuit means including said pressure actuated switch in said closed contact position connecting said winding of said first valve across said power source through said thermostat for maintaining said first valve open when said thermostatically actuated switch is in said hot position; and means for exhausting said expansible chamber of said second valve to permit closing of said second valve when said first or third valve closes.

4. The gas burner control system claimed in claim 3 wherein said pilot burner requires a minimum value of gas pressure to maintain a flame adequate to ignite said main burner, and said pressure actuated switch is constructed so that said predetermined gas pressure to actuate said pressure actuated switch to said closed contact position is a higher value than said minimum value.

5. The gas burner control system claimed in claim 3 which further includes a rotary plug cock in said main gas passageway between said first and second valves.

6. The gas burner control system claimed in claim 3 which further includes an orifice in said third branch passage.

* * * * *